US007080620B2

(12) United States Patent
Aronsson et al.

(10) Patent No.: US 7,080,620 B2
(45) Date of Patent: Jul. 25, 2006

(54) CRANKCASE SCAVENGED INTERNAL COMBUSTION ENGINE

(75) Inventors: Tore Aronsson, Molndal (SE); Niklas Enander, Gothenburg (SE)

(73) Assignee: Aktiebolaget Electrolux, Stockholm (SE)

( * ) Notice: Subject to any disclaimer, the term of this patent is extended or adjusted under 35 U.S.C. 154(b) by 172 days.

(21) Appl. No.: 10/901,860

(22) Filed: Jul. 29, 2004

(65) Prior Publication Data

US 2005/0022775 A1 Feb. 3, 2005

Related U.S. Application Data

(63) Continuation-in-part of application No. PCT/SE02/00175, filed on Jan. 30, 2002.

(51) Int. Cl.
*F01M 1/00* (2006.01)

(52) U.S. Cl. ..... 123/196 R; 123/196 W; 184/1.5; 184/11.2; 184/46

(58) Field of Classification Search ..... 123/196 R, 123/196 W; 184/11.2, 1.5, 46
See application file for complete search history.

(56) References Cited

U.S. PATENT DOCUMENTS 5,887,678 A * 3/1999 Lavender ..... 184/11.2
6,223,713 B1 * 5/2001 Moorman et al. ..... 123/196 R
6,810,849 B1 * 11/2004 Hirsch et al. ..... 123/185.3

FOREIGN PATENT DOCUMENTS

| | | |
|---|---|---|
| EP | 0 887 520 A1 | 12/1998 |
| EP | 0 962 630 A2 | 12/1999 |
| EP | 1 134 366 A1 | 9/2001 |

* cited by examiner

*Primary Examiner*—Tony M. Argenbright
*Assistant Examiner*—Katrina Harris
(74) *Attorney, Agent, or Firm*—Pearne & Gordon LLP

(57) ABSTRACT

An internal combustion engine including structure for lubricating at least one bearing disposed therein. The engine includes an engine housing including a cylinder with a reciprocating piston of the engine and a crankcase volume with a crankshaft having the at least one bearing operatively connected thereto, wherein the crankcase volume contains at least air and a lubricant. Additionally, the engine includes a counterweight arrangement that provides an essentially solid circular profile, at least one passageway on the counterweight arrangement extending to a location adjacent to the engine housing, and at least one passageway extending through the engine housing from a location adjacent to the counterweight to the at least one bearing, wherein the two passageways are selectably aligned by movement of the piston to cause a lubricating flow between the at least one bearing and the crankcase volume.

24 Claims, 8 Drawing Sheets

CRANKCASE SCAVENGED INTERNAL COMBUSTION ENGINE

RELATED APPLICATION DATA

This application is a continuation-in-part of international patent application Ser. No. PCT/SE02/00175 entitled "CRANKCASE SCAVENGED INTERNAL COMBUSTION ENGINE", filed Jan. 30, 2002, which is incorporated by reference herein.

TECHNICAL FIELD

The subject invention refers to a crankcase scavenged internal combustion engine for a portable tool, such as a chain saw or a power cutter. It comprises a cylinder with a reciprocating piston that above itself delimits a combustion chamber and below itself delimits a crankcase volume with a crankshaft, and the crankcase volume contains at least air and a lubricant, e.g., oil.

BACKGROUND OF THE INVENTION

Portable tools such as chain saws or power cutters are used in many different handling positions, even up side down. They are therefore usually crankcase scavenged and lubricant, e.g., oil is supplied to the crankcase. This lubrication system works in every handling position.

However, oil tends to collect in the crankcase so there is a surplus in the crankcase and tends to be a shortage for some lubricating places. By adding more oil this can of course be compensated for, but this will increase oil consumption and increase emissions of oil smoke in the exhaust gases.

There are even lubricating places that are very difficult to lubricate at all, e.g., a bearing on the crankshaft supporting a centrifugal clutch normally used for portable tools. Some tools use a sealed bearing that is pre-filled with grease.

The seals will wear resulting in loss of grease and the shaft will corrode increasing the wear of the seals and the loss of grease and shortening the life of the bearing.

Other tools use a duct arranged in the crankshaft so that one end of the duct reaches the bearing area. The other end of the duct either ends in the crankcase to get oilmist there, or ends in the outer end of the crankshaft to be lubricated with grease occasionally. In both cases the efficiency is limited and also dirt easily fills the respective duct so that the lubrication will be decreased or stopped.

PURPOSE OF THE INVENTION

The purpose of the subject invention is to substantially reduce the above outlined problems and to achieve advantages in many respects.

SUMMARY OF THE INVENTION

In accordance with one aspect, the present invention provides an internal combustion engine including structure for lubricating at least one bearing disposed therein. The engine includes an engine housing including a cylinder with a reciprocating piston of the engine and a crankcase volume with a crankshaft having the at least one bearing operatively connected thereto, wherein the crankcase volume contains at least air and a lubricant. Additionally, the engine includes a counterweight arrangement that provides an essentially solid circular profile, at least one passageway on the counterweight arrangement extending to a location adjacent to the engine housing, and at least one passageway extending through the engine housing from a location adjacent to the counterweight to the at least one bearing, wherein the two passageways are selectably aligned by movement of the piston to cause a lubricating flow between the at least one bearing and the crankcase volume.

In accordance with another aspect, the present invention provides a method for lubricating bearings disposed within an internal combustion engine. The method includes the steps of: (a) providing an engine housing including a cylinder with a reciprocating piston of the engine and a crankcase volume with a crankshaft having the at least one bearing operatively connected thereto, wherein the crankcase volume contains at least air and a lubricant; (b) providing a counterweight arrangement that provides an essentially solid circular profile; (c) providing at least one passageway on the counterweight arrangement extending to a location adjacent to the engine housing; (d) providing at least one passageway extending through the engine housing from a location adjacent to the counterweight to the at-least one bearing; and (e) selectably aligning the two passageways by movement of the piston to cause a lubricating flow between the at least one bearing and the crankcase volume.

BRIEF DESCRIPTION OF THE DRAWINGS

The invention will be described in closer detail in the following by way of various embodiments thereof, with reference to the accompanying drawing figures, in which the same numbers in the different figures state one another's corresponding parts.

DESCRIPTION OF EXAMPLE EMBODIMENTS

Figure 1:
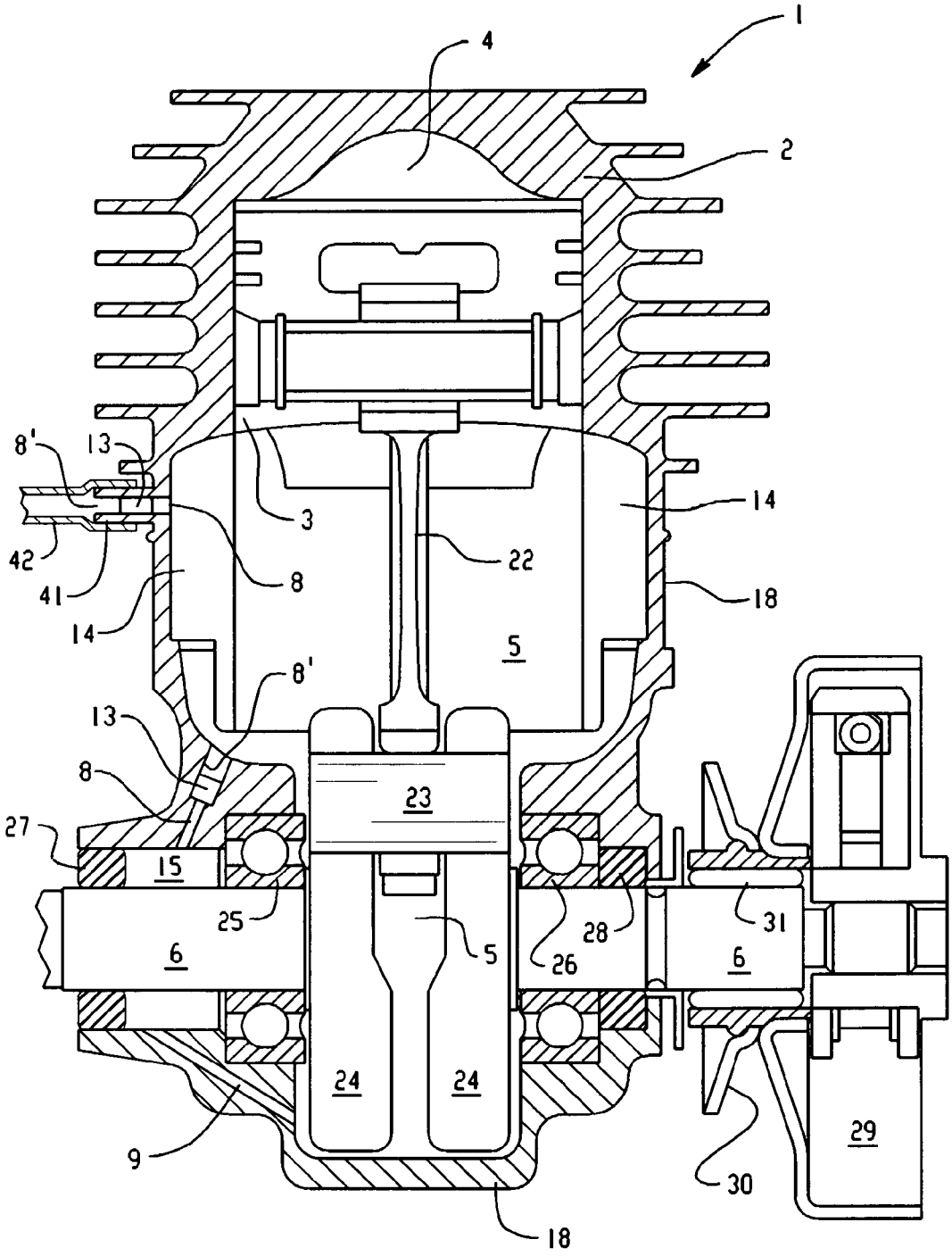
FIG. 1 is a schematic, essentially bisected elevated view of an internal combustion engine configured according to the teachings of the present invention. The crankshaft is however only bisected locally.

As appears from FIG. 1, an internal combustion engine 1 is shown configured according to the teachings of the presently disclosed invention. It is a crankcase scavenged engine of the two-stroke type. It has no valves in the shown embodiments, but can have valves and be of two-stroke or four-stroke type or similar arrangement. It is usually a petrol engine using an ignition plug, that is not shown. A cylinder 2 houses a reciprocating piston 3 that above itself delimits a combustion chamber 4 and below itself delimits a crankcase volume 5 with a crankshaft 6. The piston 3 is connected to a crankshaft pin 23 by a piston rod 22. The crankshaft pin 23 is mounted in a counterweight arrangement 24 and part of the crankshaft assembly. The crankshaft 6 is mounted in two crankshaft bearings 25, 26. It is sealed with two crankcase seals 27, 28. The engine has a number of scavenging ducts 14. All this is entirely conventional and will therefore not be further described.

On the right end of the crankshaft a centrifugal clutch 29 is mounted, and it connects or disconnects a transmission pulley 30, that is rotationally mounted on a crankshaft by way of a bearing 31 usually of a roller bearing type. This is a conventional arrangement for a power cutter, but of course the centrifugal clutch 29 could also drive a chain sprocket for a chainsaw. Different drive arrangements with or without a centrifugal clutch are of course possible.

The engine is arranged so that a lubricant 7, e.g. oil, is supplied to the crankcase 5. The lubricant could be supplied dispersed in the fuel and supplied in a conventional carburetor, or in a low-pressure injection system feeding an intake duct in a similar way as a carburetor does. However, the lubricant could also be supplied by itself from a tank using a simple pump or by a system of check valves it could feed the lubricant to the crankcase using the pressure variations in the crankcase due to the crankcase scavenging system. In the latter case the engine could have a direct injection system injecting only fuel into the combustion chamber 4 and scavenge air and the lubricant from the crankcase.

Figure 2:
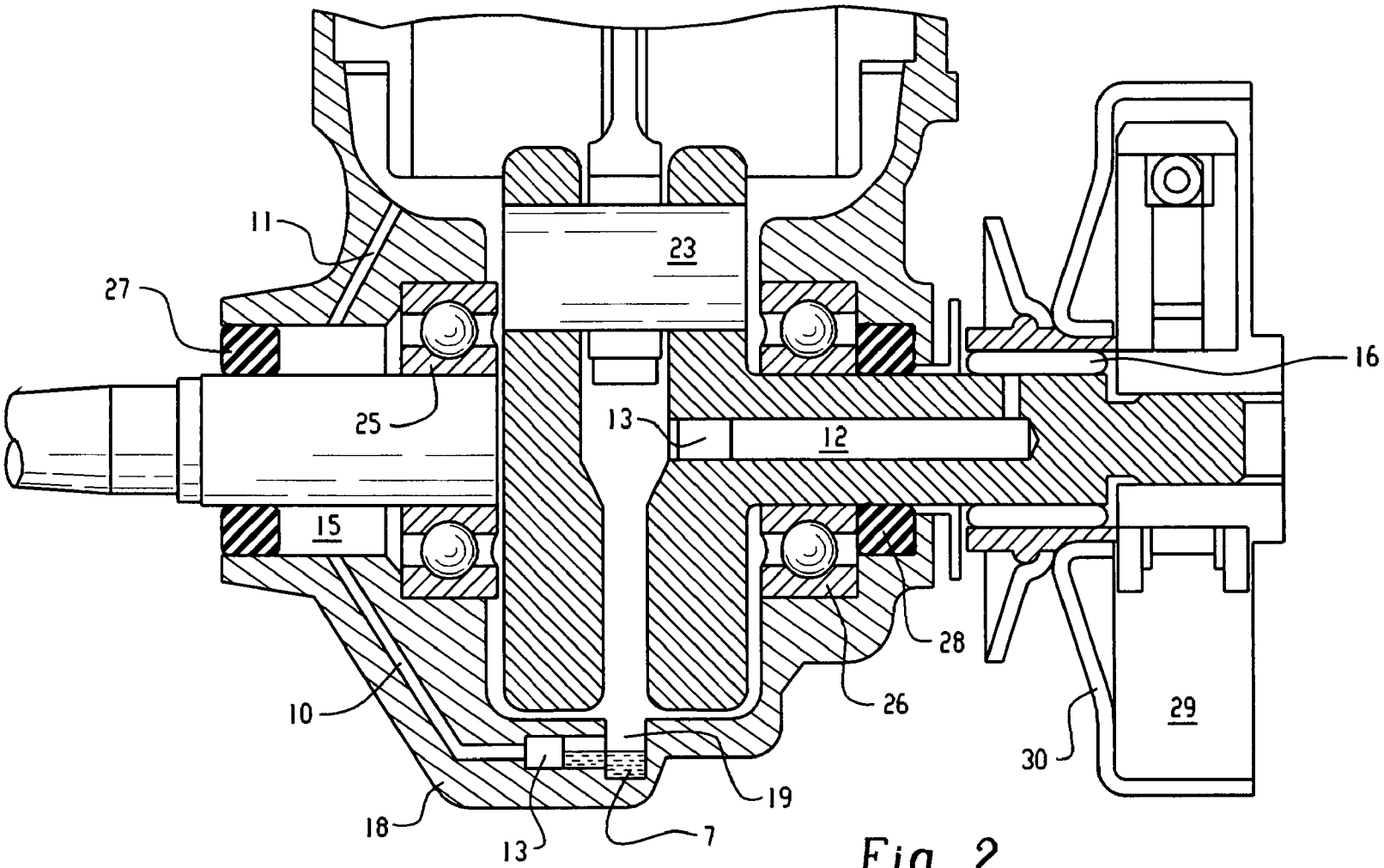
FIG. 2 is a schematic, enlarged view of the bottom part of FIG. 1. It shows a second embodiment of a lubrication system for the engine. The crankshaft is only bisected locally.
Figure 4:
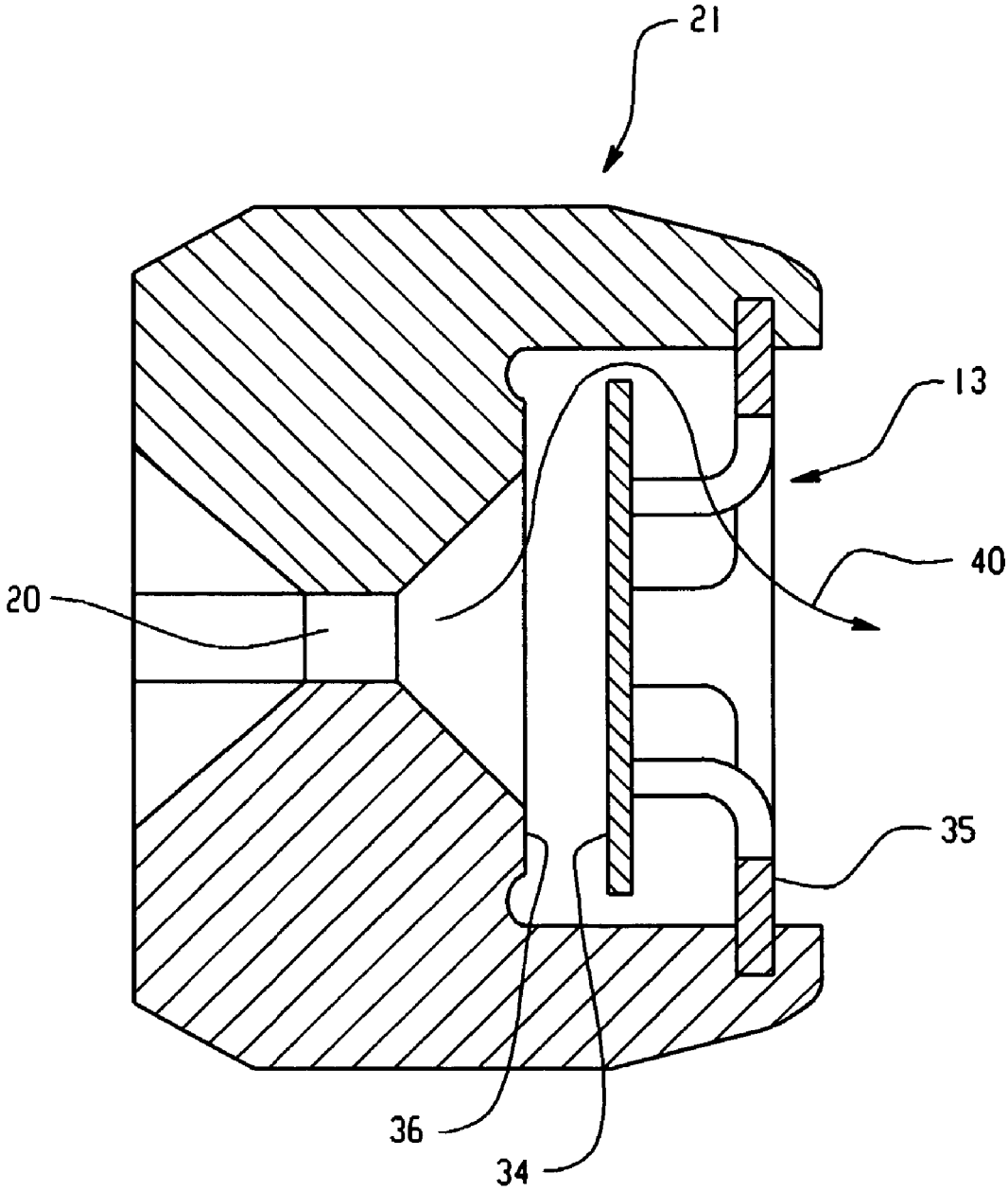
FIG. 4 shows in strong enlargement a schematic, cross-sectional view of a check valve unit comprising a check valve and a throttling.

A duct 8 has a widened part 8' and in this widened part a check valve 13 is located. The part of the duct 8 with a smaller diameter can be used as a throttling, but this throttling can also be combined with the check valve 13 to form an integrated check valve unit 21, as shown in FIG. 4. Due to the pressure variations in the crankcase there will be a pressure variation between the two ends of the duct 8. The check valve 13 will only allow flow in one direction. If that direction is downwards in the figure air and lubricant will flow downwards to the lubricating place 15, and from there back to the crankcase volume 5. If there is no other connection the flow will take place through the crankshaft bearing 25. If, on the other hand the check valve is mounted in the other direction, the flow will take the opposite route, from the crankcase through the crankcase bearing 25 and through the duct 8. It is also possible to use a return duct 9 that is arranged from the lubricating place 15 back to the crankcase volume 5, or to a connected volume 14. The scavenging channel 14 is an example of a connected volume. A connected volume could also be an intake duct. In a crankcase scavenged engine the intake duct is connected and disconnected by the piston 3, or a check valve, a so called reed-valve. In this way it is possible to supply a surplus of lubricant from a part of the crankcase volume 5 where it will serve no special purpose and supply it back to the intake duct. In this way it can make better use and thereby reduce the total consumption of lubricant and/or make the lubrication more efficient. In an engine with valves the connected volume could be a volume containing a drive mechanism for the valves. This is of course of particular interest for a four-stroke engine. But possibly also for a two-stroke engine with valves. Using a return line 9 gives a possibility to seal the crankshaft bearings 25, as shown in FIG. 2. This reduces the crankcase volume resulting in a power increase and/or reduced exhaust emissions. The lubrication of the bearing can also be better controlled using only ducts 11 and 10. It would also be possible to have a check valve 13 in the return line 9 in FIG. 1. There could even be two or three or more check valves in every duct. If there is no check valve in duct 9, this duct preferably has a smaller cross section area compared to duct 8 to reduce the flow in line 9. This could increase the flow of lubricant through the duct system 8, 9. Of course the check valves could be oriented in either direction so that the flow is either downwards through the ducts 8, 9 or upwards through these ducts.

FIG. 1 also shows a nozzle 41 supplied with the check valve 13 and a tube 42. Therefore oil on the wall of the scavenging duct 14 and air with oilmist will flow through the tube 42 and back to the crankcase 5 or to a connected volume 14, such as the intake duct. The tube 42 is connected accordingly, but this is not shown. This oil would otherwise have reached the combustion chamber. Therefore oil consumption and exhaust emissions are decreased. The nipple 41 is situated preferably where there is plenty of oil but not so high that it is reached by exhaust gases.

FIG. 2 shows a second embodiment of the lubrication system. A collecting cavity 19 is arranged in a delimiting wall 18 of the crankcase volume. It could also be arranged in the wall 18 of a connected volume. The check valve 13, or the duct that it is positioned in, 10, 10' connect to the collecting cavity 19. Lubricant 7 will fill this collecting cavity 19, partly or fully. A return duct 11 is arranged in the wall 18. In this way the duct 10 and its check valve 13 will contact a mixture having more lubricant 7 than was available in the first embodiment. However, also in this embodiment the collecting cavity 19 could be arranged at the mouth of the duct 8, here shown as 8'. The collecting cavity could also be located in a connected volume, as explained earlier.

FIG. 2 also shows another embodiment for lubrication. The check valve 13, and the duct 12 it is located in, are arranged in the crankshaft 6 and not in the delimiting wall 18. The check valve is arranged so that it gives flow outwards from the crankcase volume, and a connecting part of the duct 12 supplies oil from the center of the crankshaft to its surface below the bearing 31, in this case a roller bearing carrying the transmission pulley 30. In this way a mixture of air and lubricant is supplied to the bearing 31 and the area around it that forms the lubricating place 16. In this arrangement obviously air and lubricant is lost through the bearing. But it must be understood that the amount of lubricant necessary for this lubrication purpose is very small, and a throttling is arranged in the system to control that the correct amount is given. Preferably a check valve unit 21 according to FIG. 4 is used.

It is also possible to arrange a second connecting part of the duct 12. This part should then supply oil from the center of the crankshaft to its surface between bearing 26 and crankcase seal 28. Preferably a throttle part can be added between the two connecting parts of the duct 12 to give correct amounts of flow to both lubricating places, and preferably a bearing washer (not shown) used to restrict flow through the bearing is then also used for bearing 26.

Figure 3:
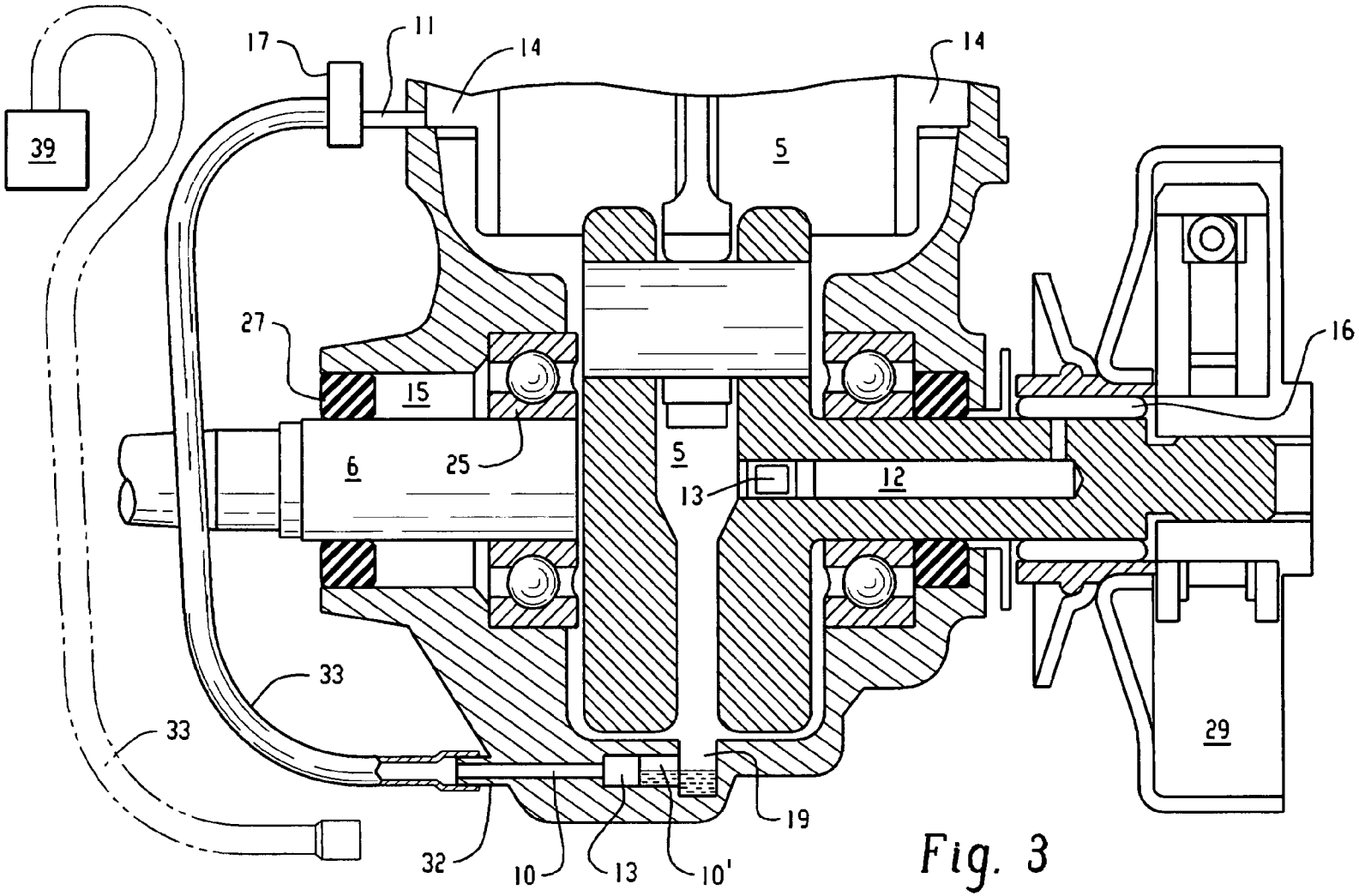
FIG. 3 corresponds to FIG. 2, but shows a schematic, third embodiment of the lubrication system, and a possible fourth embodiment.

FIG. 3 shows a third, and possibly a fourth embodiment, of the lubrication system. The duct 10 is in this case arranged so that the flow through the check valve 13 can leave the engine proper and go to an external lubricating place 17. It is here marked as a box, but it could be, of course, any kind of lubricating place, such as a bearing, a seal, wear surfaces or similar, that could use a small amount of lubricant. Transport from the engine proper to this external lubricating place 17 is arranged through a tube 33, which is mounted onto a nipple 32. In this embodiment there could also be a return duct entering into the crankcase or a connected volume, such as the intake duct. A further alternative embodiment is marked with dashed lines. In this case a similar tube 33 connects to the nipple 32, and leads to an oil tank 39. This can have a deaeration system in a conventional way. From this oil tank a line could go back to the engine crankcase volume 5, or to a connected volume 14, such as the intake duct, but this is not shown. In this way the lubricant is used more efficiently, as the surplus in the cavity 19 is used. This could make it possible to reduce the total amount of lubricant used thereby also reducing air pollution.

FIG. 4 shows the check valve unit 21 consisting of the check valve 13 and a possible throttling 20. They are integrated in a compact unit that is easy to press into the duct. The check valve 13 contains a washer 34 that can seal against an abutment area 36 when the flow tends to go in the left direction. This prohibits a flow in this direction. In the other direction flow is possible according to the arrow 40. The flow goes around the washer 34, and through a spacer 35.

Figure 5:
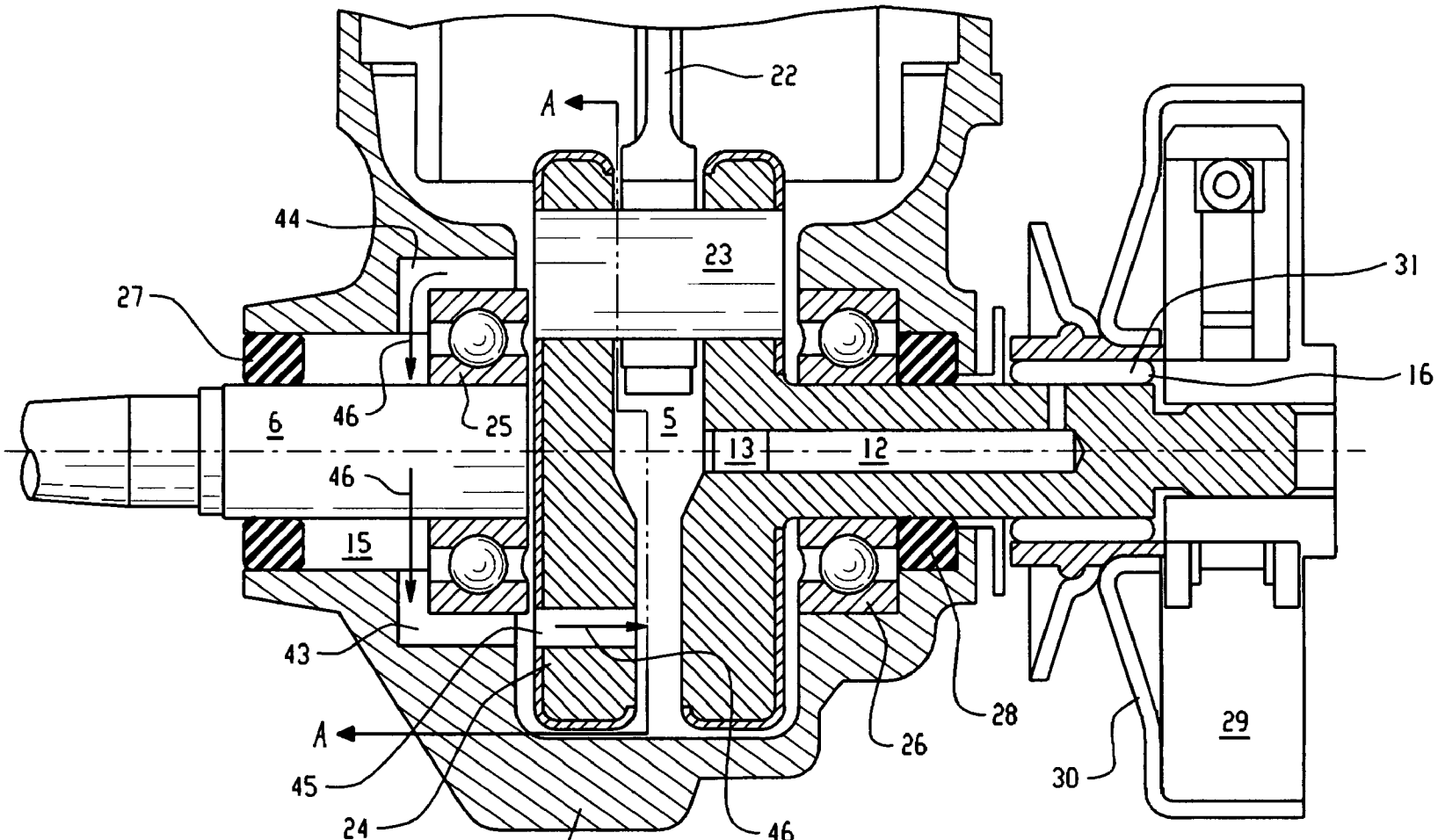
FIG. 5 is a schematic, bisected elevated view of an internal combustion engine configured according to an embodiment of a lubrication system for the engine. The crankshaft is only bisected locally.

FIG. 5 shows an additional example embodiment of the lubrication system for the engine. At least one passageway 45 on the counterweight arrangement 24 extends to a location adjacent to the wall 18 of the engine housing. In the example embodiment shown in FIG. 5, the passageway 45 comprises a passageway 45 extending through the counterweight arrangement 24. However, it is to be appreciated that the passageway 45 may comprise any structure that allows a lubricating flow to pass through or along the counterweight arrangement 24. At least one housing passageway 43 extends through the wall 18 of the engine housing from a location adjacent to the counterweight arrangement 24 to at least one bearing 25. In the example embodiment shown in FIG. 5, an upper housing passageway 44 and a lower housing passageway 43 extend through the wall 18 of the engine housing from locations adjacent to the counterweight arrangement 24 to the bearing 25.

Figure 6:
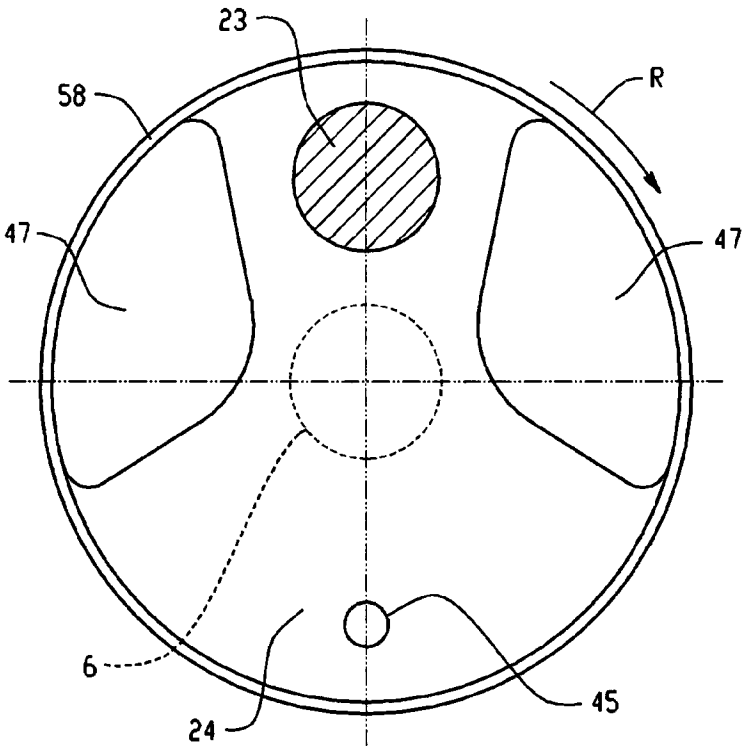
FIG. 6 is a schematic, sectional view of the crankshaft connection along section line A—A of FIG. 5.

The passageways 43, 44, 45 are selectably aligned by movement of the reciprocating piston 3 to cause a lubricating flow 46 of air and lubricant between the crankcase volume 5 and at least one bearing 25. Turning briefly to FIG. 6, the counterweight arrangement 24 comprises at least one lightweight filling 47 integrated therein by a retaining cup 58 and provides an essentially circular profile. The passageway 45 on the counterweight arrangement 24 is located at a position generally opposite the crankshaft pin 23 that connects the crankshaft 6 to the piston 3 (not shown). The movement of the reciprocating piston 3 causes rotation R of the counterweight arrangement 24 and the passageway 45. Thus, turning back to FIG. 5, the passageway 45 will be aligned with the upper housing passageway 44 when the reciprocating piston 3 moves in a relatively downward fashion, and with the lower housing passageway 43 when the reciprocating piston 3 moves in a relatively upward fashion. Accordingly, the upper housing passageway 44 and the lower housing passageway 43 are positioned correspondingly.

As the reciprocating piston 3 moves in a relatively downward fashion within the cylinder 2, a reduction in volume of the crankcase volume 5 below the piston 3 causes a maximum pressure on the air and lubricant mixture contained therein. In the example embodiment shown in FIG. 5, the maximum pressure forces the lubricating flow 46 from the crankcase volume 5, through the passageway 45 on the counterweight arrangement 24, and through the upper housing passageway 44 to the lubricating place 15 adjacent to the bearing 25. As the reciprocating piston 3 moves in a relatively upward fashion within the cylinder 2, an increase in volume of the crankcase volume 5 causes a minimum pressure on the air and lubricant mixture contained therein. In the example embodiment shown in FIG. 5, the minimum pressure draws the lubricating flow 46 from the lubricating place 15 adjacent to the bearing 25, through the lower housing passageway 43, through the passageway 45 on the counterweight arrangement 24, and back into the crankcase volume 5.

The passageways 43, 44, 45 are shown positioned in FIG. 5 such that they are selectably aligned when the reciprocating piston 3 is in either the top dead center or bottom dead center locations. The lower housing passageway 43 is shown located at a position rotated approximately 180° about the center of rotation of the crankshaft 6 from the upper housing passageway 44. It is to be appreciated that the positions of the passageways 43, 44, 45 may be varied to ensure that the lubricating flow 46 is caused to be transferred from the crankcase volume 5 to the bearing 25 only when the maximum and minimum pressures are present within the crankcase volume 5. In an alternate example embodiment shown in FIG. 7, passageway 45 and lower housing passageway 43 (not shown) are positioned at locations rotated approximately 45° from the bottom dead center location. Correspondingly, upper housing passageway 44 (shown in phantom) is positioned at a location rotated approximately 45° from the top dead center location. It is to be appreciated that the passageways 43, 44, 45 may be rotated about any angle before or after the top dead center or bottom dead center locations.

Additionally, turning back to FIG. 5, a duct 12 and a check valve 13 are arranged within the crankshaft 6. The check valve 13 is arranged such that it allows flow outwards from the crankcase volume 5. A connecting part of the duct 12 supplies oil from the center of the crankshaft 6 to its surface below the bearing 31, in this case a roller bearing carrying the transmission pulley 30. In this way a mixture of air and lubricant is supplied to the bearing 31 and the area around it that forms the lubricating place 16. In this arrangement obviously air and lubricant are lost through the bearing. But it must be understood that the amount of lubricant necessary for this lubrication purpose is very small, and throttling is arranged in the system to ensure that the correct amount is given. Preferably, the check valve 13 is a check valve unit 21 according to FIG. 4.

Figure 8:
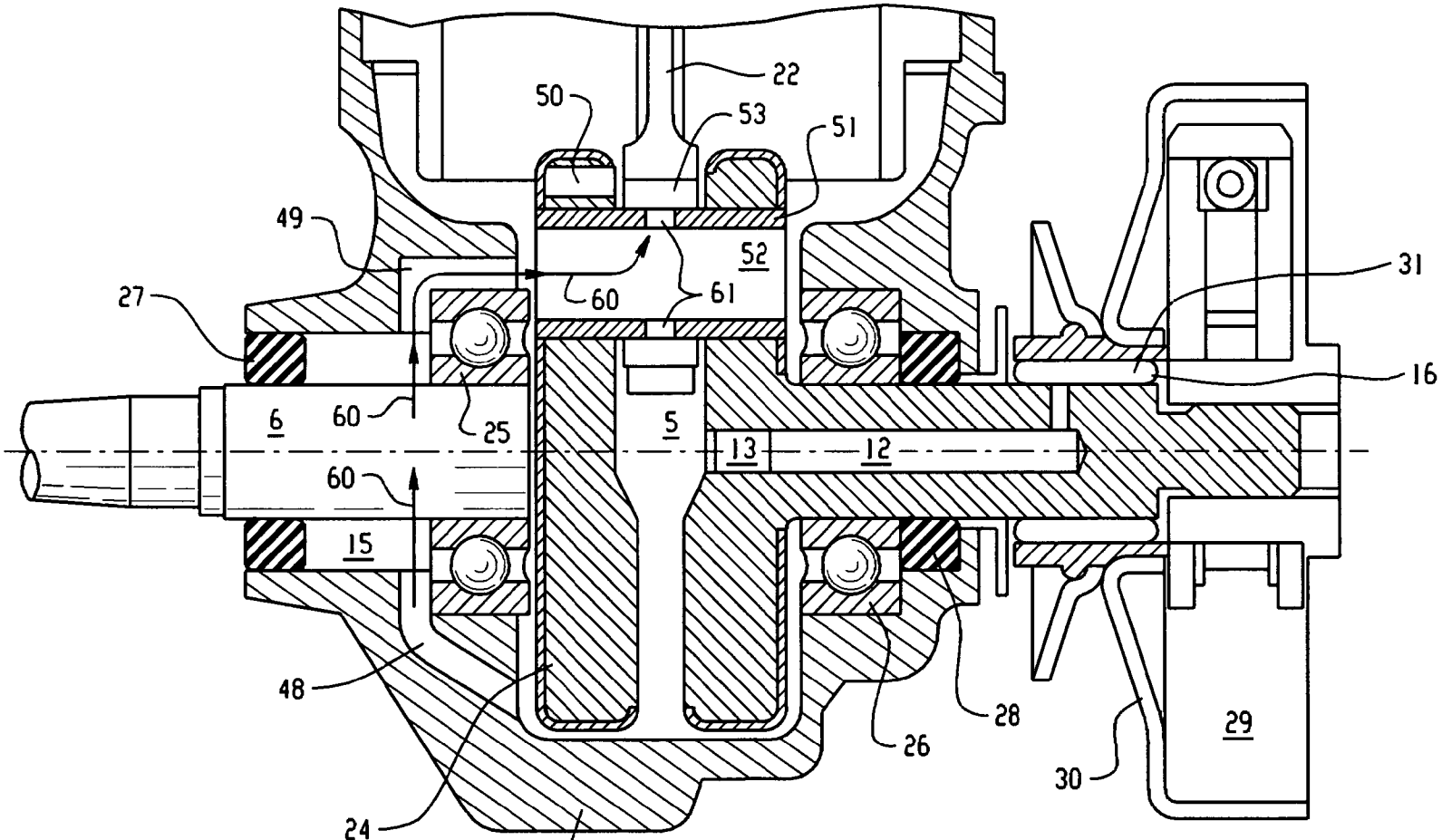
FIG. 8 is similar to FIG. 5, but shows an additional embodiment of a lubrication system for the engine. The crankshaft is only bisected locally.

FIG. 8 shows an additional example embodiment of the lubrication system for the engine. At least one passageway 50 on the counterweight arrangement 24 extends to a location adjacent to the wall 18 of the engine housing. The passageway 50 is positioned at a radial distance from the center of rotation of the counterweight arrangement 24 that is greater than the radial distance of the crankshaft pin 51. In the example embodiment shown in FIG. 8, the passageway 50 comprises a passageway 50 extending through the counterweight arrangement 24. However, it is to be appreciated that the passageway 50 may comprise any structure that allows a lubricating flow to pass through or along the counterweight arrangement 24. At least one housing passageway 48 extends through the wall 18 of the engine housing from a location adjacent to the counterweight arrangement 24 to at least one bearing 25. In the example embodiment shown in FIG. 8, an upper housing passageway 49 and a lower housing passageway 48 extend through the wall 18 of the engine housing from locations adjacent to the counterweight arrangement 24 to the bearing 25.

In the example embodiment shown in FIG. 8, the crankshaft pin 51 is a hollow pin having an interior passageway 52. Additionally, the hollow crankshaft pin 51 has at least one passageway 61 extending therethrough to a location adjacent to a piston rod bearing 53. In the example embodiment shown in FIG. 8, the passageway 61 comprises two holes extending through the hollow crankshaft pin 51 to a location adjacent to the piston rod bearing 53. It is to be appreciated that the passageway 61 in hollow crankshaft pin 51 may comprise any structure, in any number, that allows a lubricating flow to pass therethrough to the piston rod bearing 53.

The passageways 48, 49, 50, 52 are selectably aligned by movement of the reciprocating piston 3 to cause a lubricating flow 60 of air and lubricant between the crankcase volume 5 and at least one bearing 25. The movement of the reciprocating piston 3 causes rotation R of the counterweight arrangement 24 and the passageways 50, 52. Thus, the passageway 50 will be aligned with the lower housing passageway 48 when the reciprocating piston 3 moves in a relatively downward fashion, and the passageway 52 will be aligned with the upper housing passageway 49 when the reciprocating piston 3 moves in a relatively upward fashion. Accordingly, the upper housing passageway 49 and the lower housing passageway 48 are positioned correspondingly.

As the reciprocating piston 3 moves in a relatively downward fashion within the cylinder 2, a reduction in volume of the crankcase volume 5 below the piston 3 causes a maximum pressure on the air and lubricant mixture contained therein. In the example embodiment shown in FIG. 8, the maximum pressure forces the lubricating flow 60 from the crankcase volume 5, through the passageway 50 on the counterweight arrangement 24, and through the lower housing passageway 48 to the lubricating place 15 adjacent to the bearing 25. As the reciprocating piston 3 moves in a relatively upward fashion within the cylinder 2, an increase in volume of the crankcase volume 5 causes a minimum pressure on the air and lubricant mixture contained therein. In the example embodiment shown in FIG. 8, the minimum pressure draws the lubricating flow 60 from the lubricating place 15 adjacent to the bearing 25, through the upper housing passageway 49, through the passageway 52 within the hollow crankshaft pin 51, and back into the crankcase volume 5. Additionally, the minimum pressure within the crankcase volume 5 draws the lubricating flow 60 through the passageway 61 in hollow crankshaft pin 51 to the piston rod bearing 53.

Figure 7:
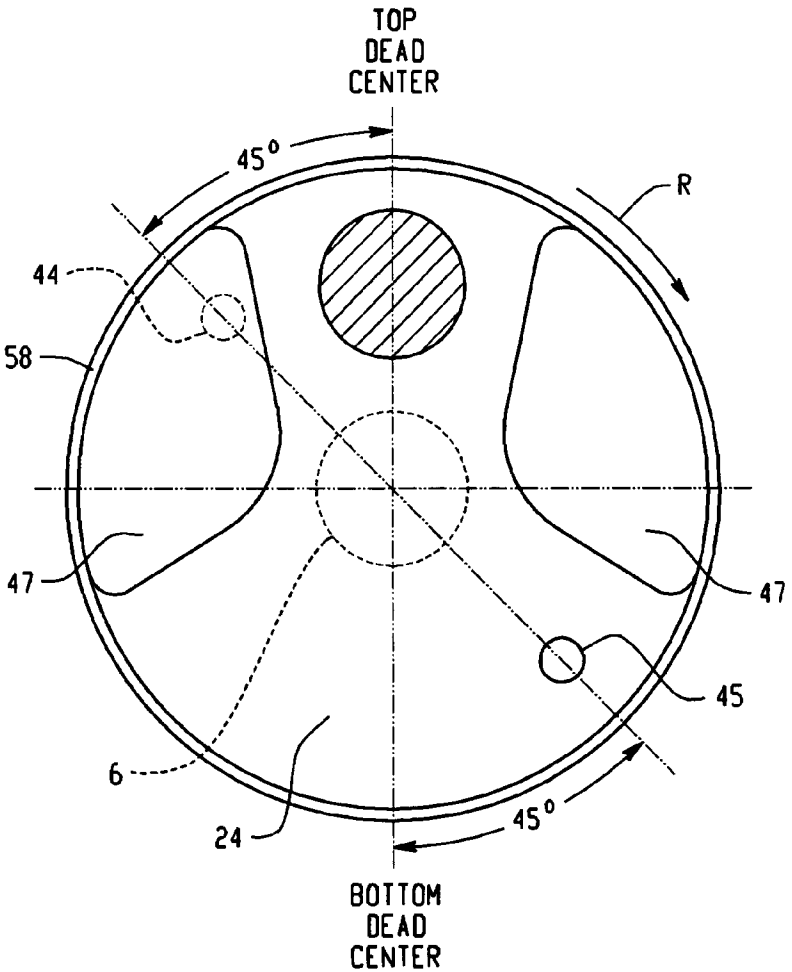
FIG. 7 is similar to FIG. 6, but shows an additional embodiment of the crankshaft connection along section line A—A of FIG. 5.

The passageways 48, 49, 50, 52 are shown positioned in FIG. 8 such that they are selectably aligned when the reciprocating piston 3 is in either the top dead center or bottom dead center locations. The lower housing passageway 48 is shown located at a position rotated approximately 180° about the center of rotation of the crankshaft 6 from the upper housing passageway 49. It is to be appreciated that the positions of the passageways 48, 49, 50, 52 may be varied to ensure that the lubricating flow 60 is caused to be transferred from the crankcase volume 5 to at least one bearing 25 only when the maximum and minimum pressures are present within the crankcase volume 5. It is to be further appreciated that the passageways 48, 49, 50, 52 may be rotated, as generally shown in FIG. 7, about any angle from the top dead center or bottom dead center locations.

Additionally, turning back to FIG. 8, a duct 12 and a check valve 13 are arranged within the crankshaft 6 so as to provide a lubricating flow 60 to the lubricating place 16 in a fashion substantially similar to the example embodiment described in accordance with FIG. 5.

Figure 9:
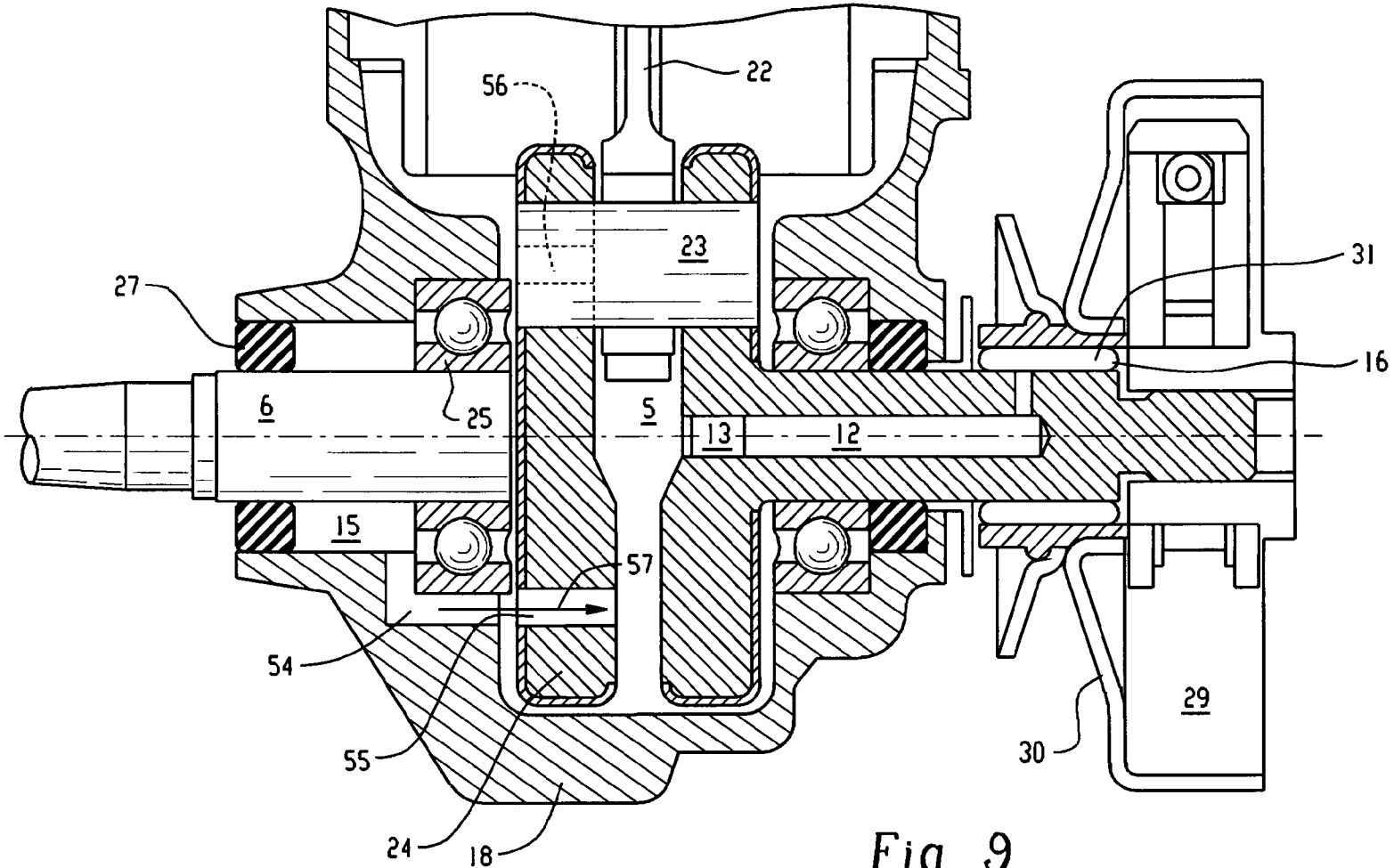
FIG. 9 is similar to FIG. 5, but shows an additional embodiment of a lubrication system for the engine. The crankshaft is only bisected locally.

FIG. 9 shows an additional example embodiment of the lubrication system for the engine. At least one passageway 57 on the counterweight arrangement 24 extends to a location adjacent to the wall 18 of the engine housing. In the example embodiment shown in FIG. 9, a lower counterweight passageway 57 and an upper counterweight passageway 56 each comprise passageways extending through the counterweight arrangement 24. However, it is to be appreciated that the passageways 56, 57 may comprise any structure that allows a lubricating flow to pass through or along the counterweight arrangement 24. At least one housing passageway 54 extends through the wall 18 of the engine housing from a location adjacent to the counterweight arrangement 24 to at least one bearing 25.

The passageways 54, 56, 57 are selectably aligned by movement of the reciprocating piston 3 to cause a lubricating flow 60 of air and lubricant between the crankcase volume 5 and at least one bearing 25. The movement of the reciprocating piston 3 causes rotation R of the counterweight arrangement 24 and the counterweight passageways 56, 57. Thus, the upper counterweight passageway 56 will be aligned with the housing passageway 54 when the reciprocating piston 3 moves in a relatively downward fashion, and the lower counterweight passageway 57 will be aligned with the housing passageway 54 when the reciprocating piston 3 moves in a relatively upward fashion. Accordingly, the housing passageway 54 is positioned correspondingly.

As the reciprocating piston 3 moves in a relatively downward fashion within the cylinder 2, a reduction in volume of the crankcase volume 5 below the piston 3 causes a maximum pressure on the air and lubricant mixture contained therein. In the example embodiment shown in FIG. 9, the maximum pressure forces the lubricating flow 57 from the crankcase volume 5, through the counterweight passageway 56 on the counterweight arrangement 24, and through the housing passageway 54 to the lubricating place 15 adjacent to the bearing 25. As the reciprocating piston 3 moves in a relatively upward fashion within the cylinder 2, an increase in volume of the crankcase volume 5 causes a minimum pressure on the air and lubricant mixture contained therein. In the example embodiment shown in FIG. 9, the minimum pressure draws the lubricating flow 60 from the lubricating place 15 adjacent to the bearing 25 back through the housing passageway 54, through the lower counterweight passageway 57, and back into the crankcase volume 5.

The passageways 54, 56, 57 are shown positioned in FIG. 9 such that they are selectably aligned when the reciprocating piston 3 is in either the top dead center or bottom dead center locations. It is to be appreciated that the positions of the passageways 54, 56, 57 may be varied to ensure that the lubricating flow 57 is caused to be transferred from the crankcase volume 5 to at least one bearing 25 only when the maximum and minimum pressures are present within the crankcase volume 5. It is to be further appreciated that the passageways 54, 56, 57 may be rotated, as generally shown in FIG. 7, about any angle from the top dead center or bottom dead center locations.

Additionally, turning back to FIG. 9, a duct 12 and a check valve 13 are arranged within the crankshaft 6 so as to provide a lubricating flow 57 to the lubricating place 16 in a fashion substantially similar to the example embodiment described in accordance with FIG. 5.

As an additional example embodiment (not shown) of the lubrication system for the engine, no passageways extend through the counterweight arrangement 24 or the wall 18 of the engine housing. Instead, a sealing washer may be fixedly attached to the bearing 25. The sealing washer includes at least one passageway extending therethrough from a location adjacent to the counterweight arrangement 24 to the bearing 25. It is to be appreciated that the passageway may comprise any structure, in any number, that allows a lubricating flow to pass therethrough.

As the reciprocating piston 3 moves in a relatively downward fashion within the cylinder 2, a reduction in volume of the crankcase volume 5 below the piston 3 causes a maximum pressure on the air and lubricant mixture contained therein. Thus, the maximum pressure forces the lubricating flow from the crankcase volume 5 through the passageways extending through the sealing washer to the bearing 25. As the reciprocating piston 3 moves in a relatively upward fashion within the cylinder 2, an increase in volume of the crankcase volume 5 causes a minimum pressure on the air and lubricant mixture contained therein. Thus, the minimum pressure draws the lubricating flow from the bearing 25 through the passageways extending through the sealing washer to the crankcase volume 5.

Additionally, a duct 12 and a check valve 13 are arranged within the crankshaft 6 so as to provide a lubricating flow to the lubricating place 16 in a fashion substantially similar to the example embodiment described in accordance with FIG. 5.

It is to be understood that the invention has been described with regard to certain example embodiments. It is to be appreciated that certain modifications, changes, adaptations, etc., are contemplated and considered within the scope of the appended claims.

The invention claimed is:

1. An internal combustion engine including structure for lubricating at least one bearing disposed therein, comprising:

an engine housing including a cylinder with a reciprocating piston of the engine and a crankcase volume with a crankshaft having the at least one bearing operatively connected thereto, wherein the crankcase volume contains at least air and a lubricant;

a counterweight arrangement that provides an essentially solid circular profile;

at least one passageway on the counterweight arrangement extending to a location adjacent to the engine housing; and at least one passageway extending through the engine housing from a location adjacent to the counterweight to the at least one bearing, wherein the two passageways are selectably aligned by movement of the piston to cause a lubricating flow between the at least one bearing and the crankcase volume.

2. The engine of claim 1, wherein the essentially solid circular profile of the counterweight arrangement comprises at least one lightweight filling integrated with the counterweight arrangement by a retaining cup.

3. The engine of claim 1, further comprising a second passageway extending through the engine housing from a location adjacent to the counterweight to the at least one bearing, wherein the second passageway is located at a position rotated approximately 180° from the first passageway extending through the engine housing.

4. The engine of claim 3, wherein the lubricating flow is forced through the first passageway extending through the engine housing to the at least one bearing when a maximum pressure is present in the crankcase, and wherein the lubricating flow is drawn from the at least one bearing through the second passageway extending through the engine housing when a minimum pressure is present in the crankcase.

5. The engine of claim 3, further comprising a passageway extending through the crankshaft to at least one lubricating place and a check valve disposed within the passageway, wherein the lubricating flow is forced through the passageway extending through the crankshaft to the at least one lubricating place when a maximum pressure is present in the crankcase, and wherein the check valve prevents the lubricating flow from being drawn back into the crankcase when a minimum pressure is present in the crankcase.

6. The engine of claim 1, wherein the locations of the at least one passageway on the counterweight arrangement and the at least one passageway extending through the engine housing are dependent upon causing the lubricating flow to transfer between the passageways when the maximum and minimum pressures are present in the crankcase.

7. The engine of claim 6, wherein the at least one passageway on the counterweight arrangement and the at least one passageway extending through the engine housing are located at a position rotated approximately 45° from the bottom dead center position of the movement of the piston.

8. The engine of claim 1, wherein the piston is integrated with the crankshaft by a hollow pin.

9. The engine of claim 8, wherein the hollow pin has at least one passageway extending therethrough to a piston rod bearing.

10. The engine of claim 9, wherein the lubricating flow is drawn from the interior of the hollow pin through the at least one passageway extending therethrough to the piston rod bearing when a minimum pressure is present in the crankcase.

11. The engine of claim 1, wherein the lubricating flow is forced through the first passageway extending through the engine housing to the at least one bearing when a maximum pressure is present in the crankcase, and wherein the lubricating flow is drawn from the at least one bearing back through the same first passageway extending through the engine housing when a minimum pressure is present in the crankcase.

12. The engine of claim 1, further comprising a sealing washer fixedly attached to the at least one bearing and having at least one passageway extending therethrough to the at least one bearing, wherein the lubricating flow is forced through the at least one passageway extending through the sealing washer to the at least one bearing when a maximum pressure is present in the crankcase, and wherein the lubricating flow is drawn from the at least one bearing through the at least one passageway extending through the sealing washer when a minimum pressure is present in the crankcase.

13. A method for lubricating bearings disposed within an internal combustion engine, the method comprising the steps of:

providing an engine housing including a cylinder with a reciprocating piston of the engine and a crankcase volume with a crankshaft having the at least one bearing operatively connected thereto, wherein the crankcase volume contains at least air and a lubricant;

providing a counterweight arrangement that provides an essentially solid circular profile;

providing at least one passageway on the counterweight arrangement extending to a location adjacent to the engine housing;

providing at least one passageway extending through the engine housing from a location adjacent to the counterweight to the at least one bearing; and selectably aligning the two passageways by movement of the piston to cause a lubricating flow between the at least one bearing and the crankcase volume.

14. The method of claim 13, wherein the essentially solid circular profile of the counterweight arrangement comprises at least one lightweight filling integrated with the counterweight arrangement by a retaining cup.

15. The method of claim 13, further comprising the step of providing a second passageway extending through the engine housing from a location adjacent to the counterweight to the at least one bearing, wherein the second passageway is located at a position rotated approximately 180° from the first passageway extending through the engine housing.

16. The method of claim 15, further comprising the steps of forcing the lubricating flow through the first passageway extending through the engine housing to the at least one bearing when a maximum pressure is present in the crankcase, and drawing the lubricating flow from the at least one bearing through the second passageway extending through the engine housing when a minimum pressure is present in the crankcase.

17. The method of claim 15, further comprising the steps of providing a passageway extending through the crankshaft to at least one lubricating place and a check valve disposed within the passageway, forcing the lubricating flow through the passageway extending through the crankshaft to the at least one lubricating place when a maximum pressure is present in the crankcase, and providing a check valve to prevent the lubricating flow from being drawn back into the crankcase when a minimum pressure is present in the crankcase.

18. The method of claim 13, further comprising the step of locating the at least one passageway on the counterweight arrangement and the at least one passageway extending through the engine housing at positions dependent upon causing the lubricating flow to transfer between the passageways when the maximum and minimum pressures are present in the crankcase.

19. The method of claim 18, further comprising the step of locating the at least one passageway on the counterweight arrangement and the at least one passageway extending through the engine housing at a position rotated approximately 45° from the bottom dead center position of the movement of the piston.

20. The method of claim 13, wherein the piston is integrated with the crankshaft by a hollow pin.

21. The method of claim 20, wherein the hollow pin has at least one passageway extending therethrough to a piston rod bearing.

22. The method of claim 21, further comprising the step of drawing the lubricating flow from the interior of the hollow pin through the at least one passageway extending therethrough to the piston rod bearing when a minimum pressure is present in the crankcase.

23. The method of claim 13, further comprising the steps of forcing the lubricating flow through the first passageway extending through the engine housing to the at least one bearing when a maximum pressure is present in the crankcase, and drawing the lubricating flow from the at least one bearing back through the same first passageway extending through the engine housing when a minimum pressure is present in the crankcase.

24. The method of claim 13, further comprising the steps of providing a sealing washer fixedly attached to the at least one bearing and having at least one passageway extending therethrough to the at least one bearing, forcing the lubricating flow through the at least one passageway extending through the sealing washer to the at least one bearing when a maximum pressure is present in the crankcase, and drawing the lubricating flow from the at least one bearing through the at least one passageway extending through the sealing washer when a minimum pressure is present in the crankcase.

* * * * *